United States Patent [19]

Ayusawa et al.

[11] 3,950,572

[45] Apr. 13, 1976

[54] METHOD FOR THE MANUFACTURE OF A HOT-ROLLED COIL HAVING EXCELLENT ADAPTABILITY FOR PICKLING

[75] Inventors: Saburo Ayusawa; Takeo Nagashima; Masaya Tsutsumi, all of Kimitsu, Japan

[73] Assignee: Nippon Steel Corporation, Tokyo, Japan

[22] Filed: Oct. 21, 1974

[21] Appl. No.: 516,397

[30] Foreign Application Priority Data

Oct. 23, 1973 Japan ..... 48-118515
May 28, 1974 Japan ..... 49-59364

[52] U.S. Cl. ..... 427/156; 427/178; 427/310; 427/318; 427/190; 427/284; 427/427; 427/435; 134/14; 134/28; 134/41; 29/527.4; 148/12 R; 148/157

[51] Int. Cl.[2] ..... C23F 11/00; C23G 1/02

[58] Field of Search ..... 427/156, 284, 310, 318, 427/401, 178; 134/14, 28, 41; 148/12 R, 12 A, 12 C, 12 D, 12 F, 12.3, 12.5, 153, 156, 155, 142, 18, 144, 134, 157, 113, 14; 29/527.4, 527.2, 424; 72/128, 146

[56] References Cited

UNITED STATES PATENTS 3,668,021 6/1972 Shoemaker ..... 148/14

*Primary Examiner*—Ralph S. Kendall
*Attorney, Agent, or Firm*—Watson Leavenworth Kelton & Taggart

[57] ABSTRACT

A hot-rolled coil having excellent adaptability for pickling can be produced by applying to the sides of the hot-rolled coil, a compound of an alkaline metal or alkaline earth metal, or an oxygen compound of boron, germanium, tin, antimony, lead, bismuth or vanadium. One or more of the aforesaid compositions when applied to a hot-rolled coil serves to suppress the formation of oxide film on the surface of the coil and/or promotes the solubility of the oxide film in the pickling tanks to the extent such oxide film does form.

11 Claims, 3 Drawing Figures

METHOD FOR THE MANUFACTURE OF A HOT-ROLLED COIL HAVING EXCELLENT ADAPTABILITY FOR PICKLING

BACKGROUND OF THE INVENTION

Field of the Invention

This invention relates to an improved method for manufacturing a hot-rolled coil having excellent adaptability for pickling in the course of producing a hot-rolled or cold-rolled steel sheets in the steel-making industry.

Description of the Prior Art

As is well-known, hot-rolled coil or steel sheet can be produced by heating a steel slab in a furnace, said heating resulting in the formation of an iron oxide film (hereinafter, "oxide film"), on the surface of the slab, removing the oxide film by means of a scale breaker, and passing the slab through a hot rolling mill to obtain a hot coil having a predetermined thickness. When it is further desired to produce a cold-rolled sheet, the hot-rolled coil thus obtained is passed through pickling tanks containing hydrochloric acid or sulfuric acid as the main component to peel off or dissolve the iron oxide film and then the coil is passed to the cold rolling mill to obtain a cold-rolled coil or steel having a predetermined thickness.

Japanese patent appln. No. 49555/73 has proposed a method for producing a steel material having excellent adaptability for pickling by coating the hot steel material just subjected to the above described hot shaping treatment with a coating agent selected to be a salt of an alkaline metal and/or boric acid. The amount of oxide film produced cannot be decreased by this treatment, but the oxide film which is produced dissolves so rapidly in the acid that the time necessary for pickling can be shortened to a satisfactory extent.

In the above method, it is thus possible to provide an oxide film having excellent adaptability for pickling, if the coating agent is applied to the hot-rolled sheet just before it is coiled, whereby the product hot-coil takes equal pickling times with respect to the ends of the coil and the middle of the coil in the width-wise direction. However, when the portion of hot-rolled sheet to be coated is small, the pickling time can be shortened only for the coated part. Thus in order to shorten the pickling time for the entire coil, including the width-wise middle part of the lengthwise middle part of the steel material, it is necessary to effect an entire coating or to effect more coating in the widthwise ends of the material, resulting in more waste of the coating agent and in a more complicated coating process. Taking as an example, hot-rolled coil, the unit for applying the coating agent must be operated throughout the hot rolling process. It is also necessary to match the line speed of the hot rolling line to the amount of coating agent sprayed so as to control the amount of coating. In addition, there are many other difficulties in the coating procedure. For example the spraying nozzle must be moved depending upon the width of the hot rolled sheet thereby making it difficult to control the width of the material to be coated. Thus it is necessary to apply a great deal of the coating agent upon the hot-rolled sheet of the effect of controlling the oxide film on the widthwise middle part of the lengthwise middle part of the hot-rolled coil is to be attained.

SUMMARY OF THE INVENTION

In view of the above disadvantages of the prior art, the inventors herein have conducted various studies of the aforesaid agents and other agents for the manufacture of hot-rolled sheet or coil. As a result, they have found that if the above-mentioned agents and other agents are coated upon the side of the hot-rolled coil by way of an aqueous solution or in powder form just after coiling, air can be prevented from passing through the coil so that in the center part of the coil, the generation of the oxide film can be suppressed and the oxide film which has rapid solubility in the acid can be produced. As a result, a hot-rolled coil having excellent adaptability for pickling can be produced whereby the pickling speed in a continuous pickling line can be increased to a great extent. When the hot-rolled sheet is to be used as is without subsequent cold rolling, it has also been found that th pickling time for the widthwise end part and the widthwise center part are equal, and the pickling itself can be effected very easily. In the case of applying a small amount of coating agent in accordance with this invention, and cannot be prevented from passing through the coil, but an oxide film having excellent adaptability for pickling can be generated in the widthwise end of the steel sheet and the pickling time for the widthwise direction of the steel sheet becomes uniform thereby accelerating pickling in a continuous pickling line.

It is therefore an object of the invention to overcome the disadvantages which have been encountered in the prior art.

It is another object of the invention to seal the side of the hot coil so as to prevent air from passing through the coil and to suppress the generation of oxide film.

It is still another object of the invention to convert the oxide film which has contacted the coating agent into an oxide film having excellent adaptability for pickling.

According to this invention there is provided a method for the manufacture of a hot-rolled coil having excellent adaptability for pickling which comprises applying to the side of a hot-rolled coil which has been just coiled after the hot-rolling process and is therefore at a high temperature a coating agent comprising, as a main component, at least one member of he group consisting of a compound of alkaline metal a compound of an alkaline earth metal an oxygen compound of boron, an oxygen compound of germanium, an oxygen compound of tin, an oxygen compound of antimony, an oxygen compound of lead, an oxygen compound of bismuth and an oxygen compound of vanadium.

The coating agent used in this invention should preferably be applied in an amount of at least $0.02 g/m^2$ per one side surface of the coil.

BRIEF DESCRIPTION OF THE DRAWING

The invention is further described with respect to the drawing, in which.

DESCRIPTION OF THE PREFERRED EMBODIMENTS

Figure 1:
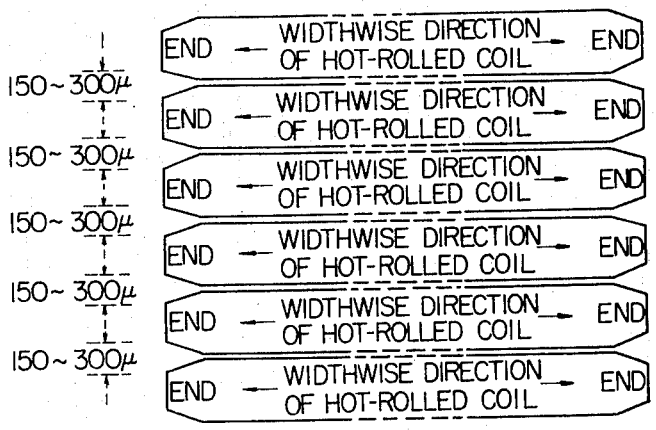
FIG. 1 is a schematic view illustrating the opening part of the widthwise end of the hot rolled coil.
Figure 2:
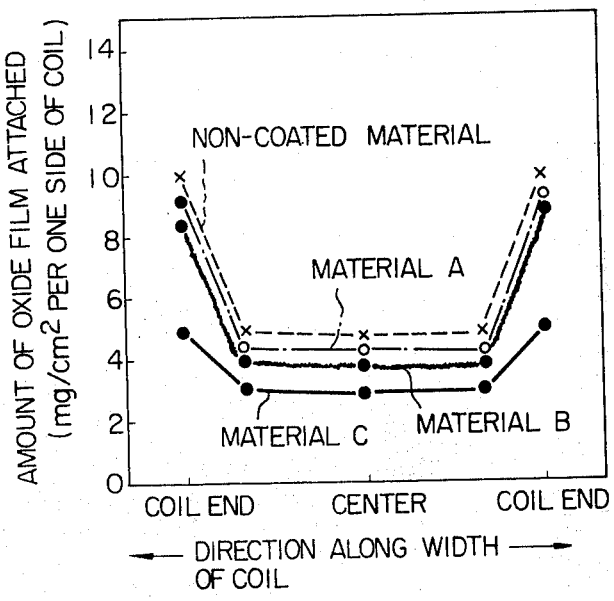
FIG. 2 shows the amount of oxide film formed on the lengthwise center part of a hot-rolled steel sheet having a thickness of 2.5 mm and coiled at 600°C. A non-coated steel material possesses the oxide distribution shown in the drawing steel material A shows the amount of oxide film attached formed on the hot-rolled coil when sodium ortho-silicate powder has been applied to both (upper and lower) surfaces of the coil in an mount of 1 mg/cm² from the widthwise end to 30 mm just before the coiling; steel material B shows the amount of oxide film formed on the not-rolled coil when boric acid has been applied according to the invention to both sides of the coil in an amount of 0.8 g/m² per one side of the coil after is over hot rolling is over and the material is coiled; and steel material C shows the amount of oxide film formed on the hot-rolled coil when boric acid has been applied according to the invention to both sides of the coil in an amount of 20 g/m² per one side of the coil after hot rolling and the material is coiled.
Figure 3:
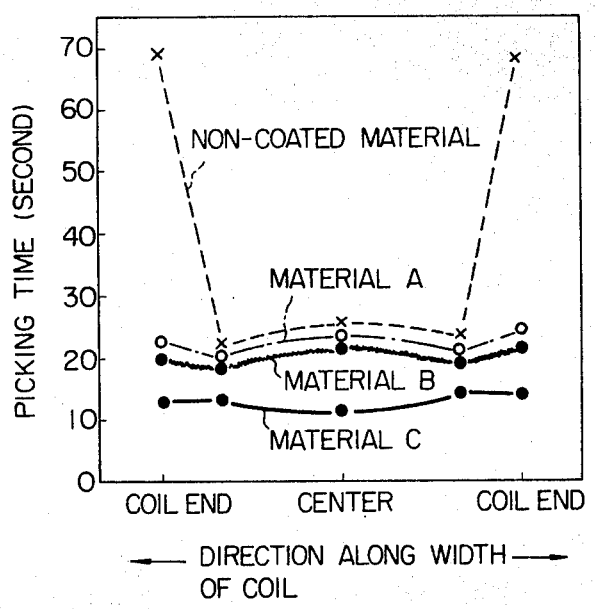
FIG. 3 shows the pickling time for the materials shown in FIG. 2.

As shown in FIG. 1, the side of the hot-rolled coil has an opening of 100 to 300 $\mu$ due to the crown (the fluctuation in thickness) of the hot-rolled steel sheet. The part of the hot-rolled coil which has a great deal of oxide film on the widthwise end thereof and thus takes a long time for pickling is the part which contacts the air around the opening portion the most. Accordingly, the part of the hot-rolled coil which corresponds to the opened portion takes a long time for pickling, which retards the velocity for pickling the hot-rolled coil. This invention provides oxide film having excellent adaptability for pickling in the opened portion of the hot-rolled coil by coating said portion with the above-mentioned coating. This invention also promotes the pickling velocity of the entire hot coil by applying a great deal of coating agent to the hot-rolled coil so as to prevent air from passing through said coil. FIG. 2 shows the amount of the widthwise oxide film formed on the lengthwise center part of hot-rolled steel sheets having a thickness of b 2.5 mm coiled at 600°C. FIG. 3 shows the pickling time for said steel sheets. The non-coated steel material is the ordinary material on which the above agent has not been applied after its being coiled. The widthwise end of the coil has a great deal of oxide film resulting in a long time for pickling. The coated material A shows the amount of oxide film formed on the hot-rolled coil and its pickling time when sodium orthosilicate power is coated on the upper and lower surfaces of the hot-rolled coil, just before its being coiled, by 1 mg/cm² from the outermost tip of the widthwise end of the coil to the 30 mm part. In this case the amount of oxide film formed on the widthwise end of the steel sheet is not changed but the oxide film formed has excellent adaptability for pickling and thus the pickling time for the widthwise end of the steel sheet can be shortened remarkably.

Steel material B shows amount of the oxide film formed on the hot-rolled steel sheet and the pickling time therefor when boric acid is the coating agent applied according to this invention on the side of the coil in the amount of 0.8 g/m² per one side of the coil after hot rolling and the material is coiled. The amount of oxide film formed on the widthwise end of the steel sheet is not changed but the pickling time for the widthwise end of the steel sheet can be shortened remarkably. Steel material C shows amount of the oxide film formed on the hot-rolled steel sheet and the pickling time therefor when boric acid is the coating agent applied according to this invention on the side of the coil in the amount of 20 g/m² per one side of the coil. In this case, the oxide film is decreased both on the widthwise end and the widthwise center of the steel sheet and the pickling time is remarkably decreased. The conditions for pickling are shown in Table 1.

Table 1

| Condition for pickling | | | |
|---|---|---|---|
| Composition of pickling solution | | Pickling method | |
| HCl | 9% | Temp.: | 90°C |
| $Fe^{++}$ | 0.5 % | Stirring: | None |
| Water | The remainder | Specimen: | not moved |

The coating agent used may be selected to be at least one member of the group consisting of a compound of alkaline metal, a compound of alkaline earth metal, an oxygen compound of boron, an oxygen compound of germanium, an oxygen compound of tin, an oxygen compound of antimony, an oxygen compound of lead, an oxygen compound of bismuth and an oxygen compound of vanadium. The temperature of the hot-rolled coil when the agent is applied thereto should be not less than the melt-adhesion temperature of the agent. Also, if the effect of suppressing the formation of the oxide film is to be expected, it is desirable that the temperature of the hot-rolled coil be higher than the melting point or the vitrescent temperature of the agent applied. The optimum temperature for coating may thus vary with the coating. Typical examples thereof are shown in Table 2.

Table 2

| Optimum temperatures of the coil for coating | |
|---|---|
| Main component of the agent used | Optimum temperature range |
| Sodium carbonate | 850–1200°C |
| Sodium borate | 740–1200°C |
| Boric acid | 450–1200°C |
| Antimony oxide | 650–1200°C |
| Lead oxide | 890–1200°C |
| Bismuth oxide | 820–1200°C |

Table 2 shows that temperatures not less than the melting point of the coating used are the optimum range. Two or more coating agents can be used in combination so as to lower the melting point or the vitrescent temperature thereof. The upper limit of the range should be a preferable range as seen from the shaping of the steel material. In some special operation which is not the ordinary rolling operation, the temperature of the steel material may be further increased before the agent coating is applied.

It is preferable that the coating should be effected as soon as possible after the hot-rolled steel sheet is coiled. When considerable time elapses between coiling and coating, the amount of oxide film formed on the hot-rolled coil is increased so that preventing formation of the oxide film can not be attained.

In case of a ordinary hot-rolled coil having a thickness of 1 mm to 4 mm and a width of 500 mm to 2000 mm, the effect of shortening the pickling time for the widthwise end of the steel sheet can be expected so long as the amount of coating agent applied is at least 0.02 g/m² per one side of the coil. In order to further attain the suppression of oxide film formation, It is necessary to use at least 1.0 g/m² coating agent per one side of the coil. Optimum range of the coating agent should be 0.08 g/m² or more per one side of the coil if the increase of the pickling velocity for the widthwise end of the steel sheet of the hot-rolled coil is to be expected, and it should be 2.0 g/m² or more per one side of the coil if suppression of oxide film formation on he hot-rolled coil is to be attained. While there is no upper limit of said range, there is no advantage to be gained by applying an excessive amount amount of coating agent. In this sense, the amount should preferably be not more than 60 g/m² per one side of the coil. The coating agent being applied may be an aqueous solution, slurry, powder, etc. Application of the coating agent may be by spraying, dipping or other methods which can apply the agent uniformly on the side of the hot-rolled coil. When coating is achieved by the use of an aqueous solution or slurry, the water will evaporate due to the heat of the hot coil so that the agent will be effectively applied in the form of a powder.

In this invention, the coating agent is applied after the hot-rolled material is coiled, resulting in great advantages in the control of the amount of agent coated as well as in the way of coating, etc. Moreover this invention will obviate the necessity of controlling the width of the material to be coated since all that should be done is to coat a predetermined amount of the agent on the hot-rolled coil which has been wound tightly.

In addition, this invention can accelerate pickling with the use of only a small amount of coating agent, since the agent is applied to only the side of the material as coiled.

The term "melt-adhesion" as herein used means the conditions that;

1. it adheres to the substance though the temperature has not reached the melting point; or
2. it melts and adheres to the substance; or
3. it half-melts and adheres to the substance.

The conditions as mentioned above may include some chemical reactions taking place concurrently.

It is generally observed that the material which causes the melt-adhesion phenomenon tends also to produce a hot-rolled coil having excellent adaptability for pickling. Above all, however, the coating agents as set forth hereinbefore exhibit particularly excellent effects. A heavy metal compound which promotes the reaction as additive, or a filler which does not take part in the reaction with the steel sheet may be to the coating agents herein added.

The alkaline metal compound used in this invention may be a hydroxide such as sodium hydroxide, lithium hydroxide, etc.; an oxide such as sodium oxide, potassium oxide, etc.; an inorganic salt such as sodium carbonate, potassium carbonate, sodium phosphate, potassium phosphate, sodium borate, potassium borate, etc.; an organic salt such as sodium formate, sodium acetate, etc.; or other compounds containing alkaline metal.

The alkaline earth metal compound may be a hydroxide such as calcium hydroxide, magnesium hydroxide, etc.; an oxide such as calcium oxide, magnesium oxide, etc.; an inorganic salt such as calcium carbonate, magnesium carbonate, calcium phosphate, magnesium phosphate, etc.; an organic salt such as calcium formate, calcium acetate, etc.; or other compounds containing alkaline earth metal.

The oxygen compound of boron may be boric acid; an oxide such as diboron trioxide, etc.; a salt of boric acid such as sodium borate, etc.

The oxygen compound of germanium may be a hydroxide such as germanium hydroxide, etc.; an oxide such as germanium oxide, etc.; germanic acid; and a salt of germanic acid or a germanate.

The oxygen compound of tin may be a hydroxide such as tin hydroxide, etc.; an oxide such as tin oxide; stannic acid; and a salt of stannic acid or a stannate.

The oxygen compound of antimony may be a hydroxide such as antimony hydroxide, etc.; an oxide such as antimony oxide, etc.; antimonic acid; a salt of antimonic acid or an antimonate.

The oxygen compound of lead may be a hydroxide such as lead hydroxide, etc.; an oxide such as lead oxide, etc.; plumbic acid; a salt of plumbic acid or a plumbate.

The oxygen compound of bismuth may be a hydroxide such as bismuth hydroxide, etc.; an oxide such as bismuth oxide, etc.; bismuthic acid; a salt of bismuthic acid or a bismuthate.

The oxygen compound of vanadium may be an oxide such as vanadium oxide, etc.; vanadic acid; a salt of vanadic acid or a vanadate.

Any substance which can produce any of the above compounds by virtue of thermal decomposition, hydrolysis, or other chemical reactions is considered as equivalent to the above compounds. Thus this invention should not be limited to the specific compounds named above.

The term "steel" as herein used means steel in general having iron as the basic component and includes the low alloy steel, etc.

EXAMPLE 1

A slurry containing 30% boric acid was applied to the sides of a hot-rolled coil having a width of 1000 mm, a thickness of 2.55 mm and the weight of 20 T, finished at 900°C and coiled at 600°C. The coating was effected by the use of an air spray in an amount of 0.6 g/m² to one side of the coil. To the other side of the coil, the coating was effected by dipping the same for 10 seconds twice into an iron-made tub containing a slurry of 30% boric acid. The coating was completed within 15 minutes after coiling, wherein the temperature of the coil was kept at 550°C or more. After this the coil was air-cooled, and was allowed to pass through the pickling line at the rate of 400 T/hour. By way of comparison, a hot-rolled coil without coating of boric acid was passed at the rate of 100 T/hour.

EXAMPLE 2

The method of Example 1 was repeated using sodium borate instead of boric acid. The treated coil could be passed through the pickling line also at the rate of 400 T/hour.

EXAMPLE 3

A slurry containing 40% sodium borate was applied to both sides of the hot-rolled coil having the width of 1200 mm, a thickness of 2.5 mm and weight of 20 T, finished at 850°C and coiled at 650°C. The coating was effected by the use of an air spray in an amount of 0.4 g/m² per one side of the coil. The coating was completed within 10 minutes after coiling, wherein the temperature of the coil was kept at 600°C or more. After being air-cooled, the coil was allowed to pass through the pickling line at a rate of 350 T/hour. The hot-rolled coil lacking the sodium borate coating could be passed through the same pickling line only at a rate of 90 T/hour.

EXAMPLE 4

An aqueous solution of 4% boric acid was applied by means of an air spray in an amount of 1.2 g/m² (per one side of the coil) to both sides of a hot-rolled coil having a width of 1300 mm, a thickness of 2.7 mm and a weight of 20 T, finished at 900°C and coiled at 650°C. The application of the coating was completed within 10 minutes after coiling, wherein the temperature of the coil was kept at 600°C or more. After being air cooled, this coil was allowed to pass through the pickling line at a rate of 350 T/hour. The coil lacking a coating of boric acid could only be passed through at a rate of 100 T/hour.

EXAMPLE 5

A slurry of 40% boric acid was applied in an amount of 8.0 g/m² (per one side of the coil) by way of an air spray on both sides of a hot-rolled coil having a width of 950 mm, a thickness of 2.4 mm and a weight of 20 T, finished at 850°C and coiled at 650°C. The application of the coating was completed within 10 minutes after coiling, wherein the temperature of the coil was kept at 600°C or more. After being air cooled, the coil could be passed through the pickling line at a rate of 460 T/hour. The hot-rolled coil lacking the coating of boric acid could be passed through at a rate of 90 T/hour.

EXAMPLE 6

The method of Example 5 was repeated except that a slurry of 40% agent composed of 50% sodium carbonate and 50% boric acid was applied instead of boric acid. The coating was effected by means of an air spray.

This hot-rolled coil could be passed through the pickling line at a rate of 450 T/hour.

EXAMPLE 7

A boric acid powder having a particle size of 50 to 200 $\mu$ was coated in an amount of 12 g/m² (per one side of the coil) by means of a powder spray to both sides of a hot-rolled coil having a width of 970 mm, a thickness of 2.55 mm and a weight of 20 T, finished at 900°C and coiled at 650°C.

The application of the coating was completed within 10 minutes after coiling, wherein the temperature of the hot-rolled coil was kept at 600°C or more.

After being air cooled, the hot-rolled coil could be passed through the pickling line at a rate of 450 T/hour, whereas uncoated hot-rolled coil could be passed therethrough only at a rate of 90 T/hour.

EXAMPLE 8

A slurry of 40% antimony oxide was applied in an agent amount of 1.2 g/m² (per one side of the coil) by the use of an air spray to both sides of a hot-rolled coil having a width of 1000 mm, a thickness of 2.70 mm and a weight of 20T, finished at 850°C and coiled at 650°C. The application of the coating was completed within 10 minutes after coiling, wherein the temperature of the hot-rolled coil is 600°C or more. After being air cooled, the coil could be passed through the pickling line at a rate of only 350 T/hour. In the case where the antimony oxide applied, it was only 100 T/hour.

EXAMPLE 9

A slurry of 40% vanadium oxide was applied in an amount of 24 g/m² (per one side of the coil) by the use of an air spray to both sides of a hot-rolled coil having a width of 1200 mm, a thickness of 2.50 mm and the weight of 20 T, finished at 900°C and coiled at 700°C.

The application of the coating was completed within 10 minutes after coiling, wherein the temperature of the coil was kept at 650°C or more. After being air cooled, the coil could be passed through the pickling line at a rate of 430 T/hour, while the coil without the coating of vanadium oxide could be passed through only at a rate of 100 T/hour.

EXAMPLE 10

A slurry of 30% boric acid was applied in an amount of 20 g/m² (per one side of the coil) by the use of an air spray to both sides of a hot-rolled coil having a width of 1150 mm, a thickness of 2.40 mm and a weight of 20 T, finished at 900°C and coiled at 600°C. The application of the coating was completed within 15 minutes after coiling, wherein the temperature of the coil was kept at 530°C or more. This hot-rolled coil was recoiled and cut to a sheet having a width of 1000 mm. When this cut sheet was subjected to pickling under the conditions shown in Table 1, it could be uniformly completed in 13 seconds. When similar pickling was carried out upon a hot-rolled coil which had not been coated, the end of the cut sheet was difficult to pickle so that it took 65 seconds to complete pickling of the entire sheet.

EXAMPLE 11

A slurry of 40% germanium oxide was applied in an amount of 25 g/m² (per one side of the coil) by the use of an air spray to both sides of a hot-rolled coil having a width of 1250 mm, a thickness of 2.60 mm and a weight of 20 T, finished at 900°C and coiled at 730°C. The coating was completed within 10 minutes after coiling, wherein the temperature of the hot-rolled coil was kept at 680°C or more. After being air cooled, this hot-rolled coil could be passed though the pickling line at a rate of 360 T/hour. The coil without coating of germanium oxide could be passed through at a rate of only 100 T/hour.

EXAMPLE 12

A slurry of 30% tin oxide was applied in an amount of 2.0 g/m² (per one side of the coil) by a use of an air spray to both sides of a hot-rolled coil having a width of 1000 mm, a thickness of 2.4 mm and a weight of 20 T, finished at 910°C and coiled at 750°C. The application of the coating was completed within 10 minutes after coiling, wherein the temperature of the coil was kept at 700°C or more.

After being air cooled, this coil was passed through the pickling line at the rate of 350 T/hour. In case where tin oxide was not applied, it was only 100 T/hour.

EXAMPLE 13

A slurry of 40% lead oxide was applied in an amount of 8.0 g/m² (per one side of the coil) to both sides of a hot-rolled coil having a width of 1300 mm, a thickness of 2.7 mm and a weight of 20 T, finished at 900°C and coiled at 700°C. The application of the coating was completed within 10 minutes after coiling, wherein the temperature of the hot-rolled coil was kept at 650°C or more. After being air cooled, this coil was passed through the pickling line at a rate of 400 T/hour. The coil without coating of lead oxide could be passed through only at a rate of 100 T/hour.

EXAMPLE 14

A slurry of 40% bismuth oxide was applied in an amount of 4 g/m² (per one side of the coil) by the use of an air spray to both sides of a hot-rolled coil having a width of 1000 mm, a thickness of 2.7 mm and a weight of 20 T, finished at 900°C and coiled at 670°C. The application of the coating was completed within 10 minutes after coiling, wherein the temperature of the hot-rolled coil was kept at 620°C or more. After being air cooled, the coil could be passed through the pickling line at a rate of 400 T/hour. The coil without coating of bismuth oxide could be passed through only at a rate of 90 T/hour.

EXAMPLE 15

A slurry of 10% calcium hydroxide was applied in an amount of 10 g/m² (per one side of the coil) by the use of an air spray to both sides of a hot-rolled coil having a width of 1250 mm, a thickness of 2.60 mm and a weight of 20 T, finished at 900°C and coiled at 730°C. The application of the coating was completed within 10 minutes after coiling, wherein the temperature of the coil was kept at 680°C or more. After being air cooled, the hot-rolled coil could be passed through the pickling line at a rate of 370 T/hour. The hot-rolled coil without coating of calcium hydroxide could be passed through only at a rate of 100 T/hour.

As set forth hereinabove, the velocity of pickling of the hot-rolled coil through the pickling line after it is coiled can be increased remarkably according to the method of the invention whereby productivity can be greatly enhanced.

This invention is thus highly valuable in industry.

We claim:

1. A method for the manufacture of a hot-rolled coil having excellent adaptability for pickling which comprises applying to a side of a hot-rolled coil which has just been coiled a coating agent comprising at least one member of the group consisting of lithium hydroxide, an oxygen compound of lithium, an inorganic salt of lithium, an organic salt of lithium, potassium hydroxide, an oxygen compound of potassium, an inorganic salt of potassium, an organic salt of potassium, sodium hydroxide, an oxygen compound of sodium, an inorganic salt of sodium, an organic salt of sodium, calcium hydroxide, an oxygen compound of calcium, an inorganic salt of calcium, an organic salt of calcium, magnesium hydroxide, an oxygen compound of magnesium, an inorganic salt of magnesium, an organic salt of magnesium, an oxygen compound of boron, an oxygen compound of germanium, an oxygen compound of tin, an oxygen compound of antimony, an oxygen compound of lead, an oxygen compound of bismuth and an oxygen compound of vanadium.

2. The method of claim 1 in which said coating agent is applied in an amount of at least 0.02 g/m² per one side of the coil.

3. The method of claim 1 in which said coating agent is applied as a slurry.

4. The method of claim 1 in which said coating agent is applied as an aqueous solution.

5. The method of claim 1 in which said coating agent is applied as a powder.

6. The method of claim 1 in which the temperature of the hot-rolled coil is at least the melt-adhesion temperature of said coating agent when applied.

7. The method of claim 2 in which the amount of said coating agent applied is at least 0.08 g/m².

8. The method of claim 7 in which the amount of said coating agent applied is at least 1.0 g/m².

9. The method of claim 1 in which said coating agent is applied by spraying.

10. The method of claim 1 in which said coating is applied by dipping the hot-rolled coil in an aqueous solution.

11. The method of claim 1 in which said coating agent is applied by dipping the hot-rolled coil in a slurry.

* * * * *